United States Patent [19]

Vaillancourt

[11] Patent Number: 4,682,477

[45] Date of Patent: Jul. 28, 1987

[54] CONVERTIBLE PIERCED-EARLOBE EARRING

[76] Inventor: Marilyn L. Vaillancourt, Old Never Sink Rd., Danbury, Conn. 06811

[21] Appl. No.: 800,746

[22] Filed: Nov. 22, 1985

[51] Int. Cl.[4] ..... A44C 7/00

[52] U.S. Cl. ..... 63/12; 63/29 R

[58] Field of Search ..... 63/12, 13, 29, 30; 428/99, 100

[56] References Cited

U.S. PATENT DOCUMENTS

| | | | |
|---|---|---|---|
| 758,848 | 5/1904 | Pejchar | 63/13 |
| 2,402,956 | 7/1946 | Fyfe | 63/29 R |
| 2,733,578 | 2/1956 | Tucker | 63/29 R |
| 2,775,014 | 12/1956 | Gollobin | 63/14 B |
| 4,195,492 | 4/1980 | Johnson | 63/12 |
| 4,507,344 | 3/1985 | Baughman | 63/29 R |

FOREIGN PATENT DOCUMENTS

| | | | |
|---|---|---|---|
| 2925195 | 1/1981 | Fed. Rep. of Germany | 63/12 |
| 759383 | 10/1956 | United Kingdom | 63/12 |

*Primary Examiner*—Richard J. Johnson

*Attorney, Agent, or Firm*—Salter & Michaelson

[57] ABSTRACT

A convertible pierced-earlobe earring provides for the use of a multitude of different, inexpensive ornamentations, while permitting the use of non-allergenic materials for the components of the earring which contact the wearer's earlobe. An ornamentation adapter member may be readily interchanged to permit various ornamentations to be utilized with a single gold post earring.

13 Claims, 4 Drawing Figures

FIG. 1
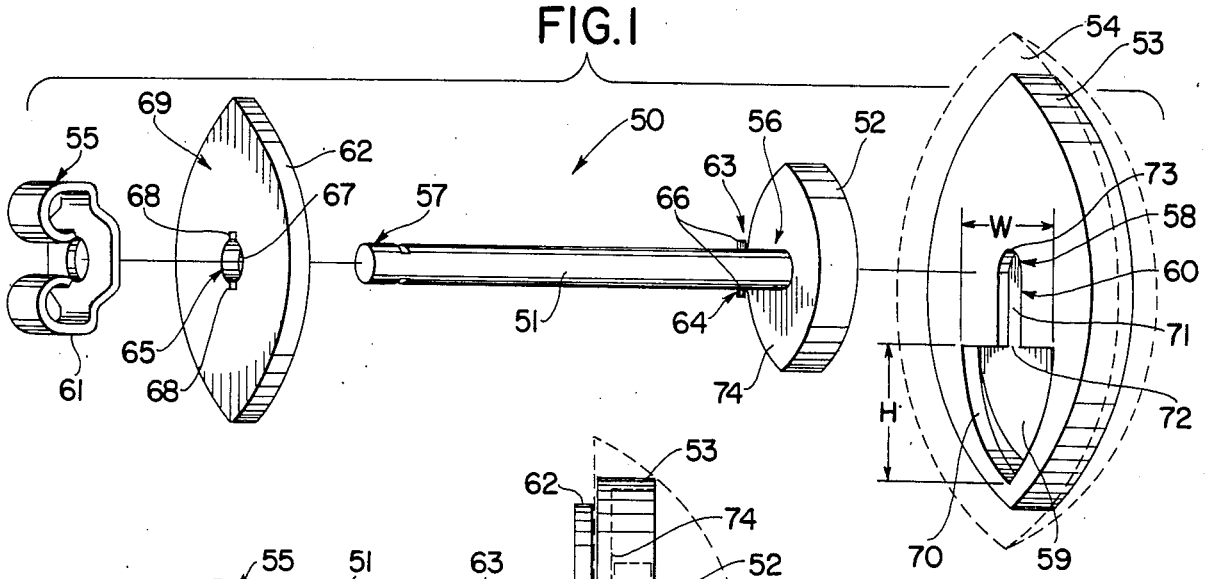
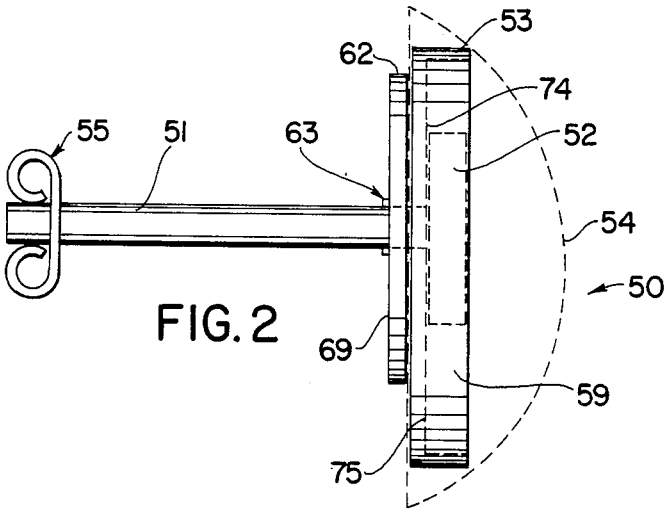
FIG. 2
FIG. 3
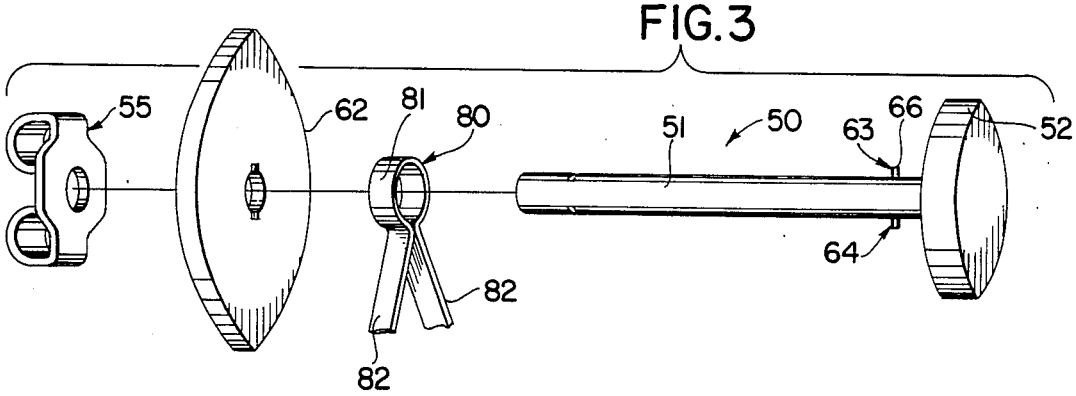
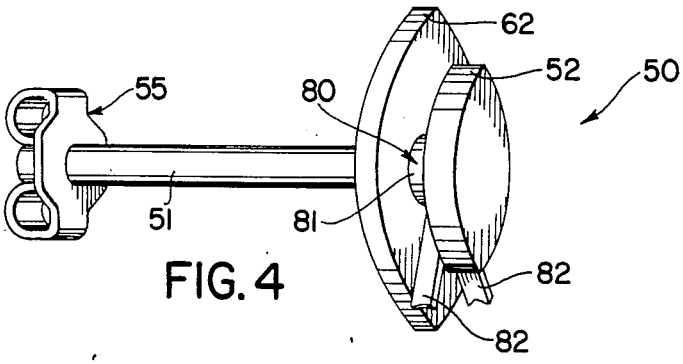
FIG. 4

CONVERTIBLE PIERCED-EARLOBE EARRING

FIELD OF THE INVENTION

The invention relates to a convertible pierced earlobe earring having an earring post, wherein the same earring post may be utilized with various types of ornamentation.

DESCRIPTION OF THE PRIOR ART

Traditionally, earrings made for pierced ears, or pierced-earlobe earrings, are manufactured with a 14 karat gold post and ornamentation of gold or other precious material, and are quite expensive due to the use of gold or other precious material. Because of this expense, manufacturers began to manufacture pierced-earlobe earrings of plastic and other more inexpensive materials to make a wider variety of fashion ornamentation available to more individuals at a more affordable cost. These more inexpensive earrings initially included 14 karat gold posts, with the ornamentation being manufactured of plastic and other inexpensive materials. Initially, the manufacturers continued to utilize 14 karat gold posts because many individuals suffer an allergic reaction from many substances other than gold, since the gold posts are inserted through the pierced portion of the earlobe.

As the cost of gold has increased, most manufacturers of inexpensive pierced-earlobe earrings have substituted other materials for the posts, in order to keep the cost of the earrings down so as to be affordable to a greater number of consumers. Whereas, a great number of wearers of pierced-earlobe earrings do not develop an allergic reaction to the materials which have been substituted for the gold posts, many individuals do suffer from an allergic reaction from contact with the inexpensive materials used in such earrings. Thus, such individuals are forced to continue to purchase pierced-earlobe earrings totally manufactured of gold, and are unable to purchase the more inexpensive earrings which offer a wide variety of types of ornamentation. For those who do suffer such allergic reactions, they typically are forced to have a fewer number of pierced-earlobe earrings manufactured from gold, due to their high expense, or they purchase the more inexpensive pierced-earlobe earrings in a larger quanity in order to have more design choices of ornamentation. However, they typically suffer the consequences resulting from the allergic reaction to the more inexpensive earrings.

Accordingly, prior to the development of the present invention, there has been no pierced-earlobe earring which: is economical to manufacture; is easily converted to have a variety of forms of inexpensive ornamentation associated therewith; and provides for the skin of the wearer to be contacted only by non-allergenic materials. Therefore, the art has sought a convertible pierced-earlobe earring which: is economical to manufacture; provides for a wide variety of inexpensive ornamentation; and provides for the wearer's skin to be only contacted by non-allergenic materials.

SUMMARY OF THE INVENTION

In accordance with the invention, the foregoing advantages have been achieved through the present convertible pierced-earlobe earring. The present invention includes: an elongate post having first and second ends and manufactured from a non-allergenic material, and adapted to be passed through an earlobe; a substantially planar, decorative end member, manufactured from a non-allergenic material, and disposed at the first end of the post in a plane substantially perpendicular to the longitudinal axis of the post; a substantially planar, ornamentation adapter member having ornamentation associated therewith and disposed adjacent the decorative end member, including means for releaseably securing the ornamentation adapter member to the decorative end member; the releaseable securing means including a cavity disposed within the ornamentation adapter member for receiving the decorative end member therein and means for engaging a portion of the post disposed adjacent the decorative end member; and means for locking the post and ornamentation adapter member, having the decorative end member received therein, with respect to the earlobe, the locking means being disposed adjacent the second end of the post and manufactured from a non-allergenic material, whereby the visual appearance of the earring may be altered through use of different ornamentation associated with the ornamentation adapter member and allergic reactions to the earring are minimized by the pierced portion of the earlobe only contacting nonallergenic materials. A feature of the present invention resides in the fact that the non-allergenic material may be gold.

A further feature of the present invention is that a substantially planar decorative shield member may be utilized, which is manufactured from a non-allergenic material, and is releaseably disposed upon the post adjacent the decorative end member and in an abutting relationship with the ornamentation adapter member.

A further feature of the present invention is that the post may include means for bracing the decorative shield member to maintain the abutting relationship between the decorative shield member and the ornamentation adapter member.

In accordance with the invention, the foregoing advantages have also been achieved through the present convertible pierced-earlobe earring, which invention includes: an elongate post having first and second ends and manufactured from a non-allergenic material, and adapted to be passed through an earlobe; a substantially planar, decorative end member, manufactured from a non-allergenic material and disposed at the first end of the post in a plane substantially perpendicular to the longitudinal axis of the post; an ornamentation member having a support member removeably disposed upon the post adjacent the decorative end member, and downwardly, extending ornamentation secured to the support member; a substantially planar decorative shield member, manufactured from a non-allergenic material, releaseably disposed upon the post adjacent the decorative end member and in an abutting relationship with the ornamentation member; and means for locking the post, ornamentation member and decorative end member with respect to the earlobe, the locking means being disposed adjacent the second end of the post and manufactured from a non-allergenic material, whereby the visual appearance of the earring may be altered through use of different ornamentation members associated with the post, and allergic reactions to the earring are minimized by the pierced portion of the earlobe only contacting non-allergenic materials.

The convertible pierced-earlobe earring of the present invention, when compared with previously proposed pierced-earlobe earrings, has the advantages of: being economical to manufacture; allows a wide variety of inexpensive ornamentation to be used; and minimizes the likelihood for the wearer to suffer an allergic reaction from the pierced-earlobe earring.

BRIEF DESCRIPTION OF THE DRAWING

In the drawings:

FIG. 1 is an exploded perspective view of a convertible pierced-earlobed earring in accordance with the present invention;

FIG. 2 is a plan view of the assembled convertible pierced-earlobe earring of FIG. 1 in accordance with the present invention;

FIG. 3 is an exploded, perspective view of another convertible pierced-earlobe earring in accordance with the present invention; and FIG. 4 is a perspective, plan view of the pierced-earlobe earring of FIG. 3 in its assembled configuration.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

In FIGS. 1 and 2, a convertible pierced-earlobe earring 50 in accordance with the present invention is shown to generally comprise: a post assembly including an elongate post 51; and a disk-like decorative end member 52, an ornamentation adaptor assembly including an ornamentation adapter member 53 having ornamentation 54 associated therewith; and means for locking 55 the post 51 and ornamentation adapter member 53, having the decorative end member 52 received therein, with respect to an earlobe (not shown). Still with reference to FIGS. 1 and 2, post 51 has first and second ends 56, 57, and post 51 may be manufactured from a suitable non-allergenic material, whereby when post 51 is passed through an individual's earlobe, the possibility of an allergic reaction occurring from the contact of post 51 to the interior of the pierced portion of the wearer's earlobe, is minimized. In this regard, the use of the term "non-allergenic material" throughout this specification and appended claims means a material such as gold, platinum, or any other material having the requisite non-allergenic properties and strength characteristics inherent in the manufature and use of an earring. Although 14 karat gold is preferred, other gold alloys, such as 18 karat gold, could also be utilized, as would be readily known to one of ordinary skill in the art.

Decorative end member 52 is also preferably manufactured from a non-allergenic material, and is disposed at the first end 56 of post 51 in a plane which is substantially perpendicular to the longitudinal axis of post 51. Decorative end member 52 may be secured to the first end of post 51 in any suitable manner such as by being formed integral with post 51, being soldered to post 51, or threadedly received upon post 51.

Ornamentation adapter member 53 my have any desired ornamentation 54 associated therewith. In this regard, ornamentation 54, which is shown in phantom lines to indicate that the shape of the ornamentation could be any shape desired, is preferably manufactured from an inexpensive plastic or metallic material. Ornamentation 54 may be formed integral with ornamentation adapter member 53, or could be releaseably secured thereto in any convenient and conventional manner, such as by a Velcro® tab, double-sided tape, or by small screws. Preferably, ornamentation 54 is manufactured of an inexpensive plastic or metallic material, and is formed integral with ornamentation adapter member 53, such as by glue or solder. As will be hereinafter described in greater detail, it is not necessary to manufacture ornamentation adapter member 53 from an expensive non-allergenic material, such as gold.

Ornamentation adapter member 53, as seen in FIG. 2, is disposed adjacent the decorative end member 52, and ornamentation adapter member 53 includes means for releaseably securing 58 the ornamentation adapter member 53 to the decorative end member 52. The releaseable securing means 58 preferably includes a cavity 59 disposed within the ornamentation adapter member 53 for receiving the decorative end member 52 therein. Releaseable securing means 58 also preferably includes means for engaging 60 a portion of the post 51 disposed adjacent the decorative end member 52, as will be hereinafter described in greater detail.

Still with reference to FIGS. 1 and 2, the means for locking 55 the post 51 and ornamentation adapter member 53 having the decorative end member 52 received therein, is disposed adjacent the second end 57 of post 51 and may likewise be manufactured from a non-allergenic material. Preferably, locking means 55 comprises a conventional earring post clip 61. It should thus be understood that after desired ornamentation adapter member 53, having ornamentation 54 associated therewith is releaseably secured via releaseable securing means 58 to decorative end member 52, post 51 is inserted through the pierced portion of the wearer's earlobe, and a clutch or locking means 55 is engaged to secure ornamentation adapter member 53, with decorative end member 52 received within cavity 59, and post 51 to the wearer's earlobe, in a conventional manner.

Still with reference to FIGS. 1 and 2, as substantially planar decorative shield member 62, manufactured from a non-allergenic material, may be releaseably disposed upon the post 51 adjacent the decorative end member 52 and in an abutting relationship with the ornamentation adapter member 53. When the decorative shield member 62 is utilized, as previously described, the components of earring 50, or post 51, locking means 55, and decorative shield member 62, which contact the wearer's earlobe, are manufactured of a non-allergenic material, whereby the likelihood of an allergic reaction occurring to the wearer of the earring is minimized. If decorative shield member is not utilized as shown and described in connection with FIG. 2, some individuals may still be able to wear earring 50 and not suffer an allergic reaction, even though the ornamentation adapter member 53 is not manufactured from a non-allergenic material, insofar as the interior of the pierced portion of the wearer's earlobe is only in contact with the non-allergenic post 51. For those individuals who might still suffer an allergic reaction because of contact of their earlobe with the exterior of the ornamentation adapter member 53, the surface of ornamentation adapter member 53, which contacts the wearer's earlobe, could be provided with a thin plating of non-allergenic material, or preferably, such an individual would always utilize decorative shield member 62 when wearing an ornmentation adapter member 53 which is manufactured from a non-allergenic material. It should be also readily apparent to one of ordinary skill in the art that an individual could wear as an earring only decorative end member 52, with post 51 and locking means 55, or only decorative end member 52, decorative shield member 62, post 51 and locking means 55.

Post 51 may be provided with a means for bracing 63 the decorative shield member 62 to maintain the abutting relationship between the decorative shield member 62 and the ornamentation adapter member 53. The bracing means 63 may comprise at least one projection 64 extending outwardly from post 51 adjacent the decorative end member 52, and the decorative shield member 62 may include an opening 65 therein to permit passage of the decorative shield member 62 over the post 51 and the at least one projection 64. Preferably, the at least one projection 64 comprises two outwardly extending pins 66 radially disposed upon the post 51 approximately 180° apart. The decorative shield member 62 may then have a first opening 67 which corresponds to the outer cross-sectional configuration of the post 51 and two openings 68 disposed adjacent the first opening 67 and radially spaced from one another approximately 180°. These openings 68 thus correspond to the outer cross-sectional configuration of the two outwardly extending pins 64, whereby decorative shield member 62 may be readily passed over post 51 with pins 66 and openings 68 being disposed in a mating relationship, whereby decorative shield member 62 may be placed in an abutting relationship with the ornamentation adapter member 63, as shown in FIG. 2. After decorative shield member 52 is in an abutting relationship with ornamentation adapter member 53, decorative shield member 62 may be rotated whereby pins 66 bear against the back surface 69 of decorative shield member 62, whereby not only is ornamentation adapter member 53 and decorative shield member 62 securely retained in an abutting relationship, but such abutting and locked relationship permits the easy assembly and insertion of earring 50 through the wearer's earlobe. It should of course be understood by one of ordinary skill in the art that other suitable forms of bracing means 63 could be utilized.

As seen in FIG. 1, ornamentation adapter member 53 may have an opening 70 formed therein which permits entry of the decorative end member 52 into cavity 59. Engagement means 60 may comprise an elongate slot or passageway 71 having first and second ends 72, 73, with the first end 72 disposed adjacent the opening 70 and in communication therewith. As seen in FIG. 1, the passageway 71 may have a configuration which corresponds to the outer cross-sectional configuration of post 51, whereby the decorative end member 52 may be first inserted through the opening 70 and into the cavity 59, and then the post 51 is moved into the first end 72 of passageway 71 until the post 51 engages the second end 73 of passageway 71, which places the decorative end member 52 and ornamentation adapter member 53 in an abutting relationship, as shown in FIG. 2.

Opening 70 and ornamentation adapter member 53 can be of any configuration, whereby decorative end member 52 may pass through opening 70 into cavity 59 of ornamentation adapter member 53. Thus, if the configuration of decorative end member 52 is circular, such as is shown in FIG. 1, opening 70 could have a circular configuration which corresponds in size to the configuration of decorative end member 52. Preferably, as is shown in FIG. 1, the opening 70 in ornamentation adapter member 53 has a configuration which is smaller than the outer configuraton of the decorative end member 52. By use of the term "smaller" is meant that were decorative end member 52 to be moved toward ornamentation adapter member 53 in a direction which is perpendicular to ornamentation adapter member 53, decorative end member 52 would not be able to pass through opening 70. Thus, as shown in FIG. 1, the width of opening 70, as shown by arrows W, is at least as great as the width of decorative end member 52, but the height, as shown by arrows H, is not as great as the height of decorative end member 52, whereby the ornamentation adapter member must be tilted with respect to the decorative end member 52 in order for decorative end member 52 to be inserted into the cavity 59. Thus, upon tilting ornamentation adapter member 53, decorative end member 52 may be first inserted through opening 70 into cavity 59, and upon post 51 entering the first end 72 of passageway 71, the remaining portion of decorative end member 52 may pass through opening 70, as post 51 is moved upwardly to abut against the second end 73 of passageway 71. Accordingly, the rear surface 74 of decorative end member 52 is in abutting relationship with the interior surface 75 of ornamentation adapter member 53, to firmly and fixedly support ornamentation adapter member 53 with respect to decorative end member 52 and post 51, to minimize ornamentation adapter member 53 from being accidentally dislodged from decorative end member 52. In this regard, when decorative shield member 62 is also utilized, and is placed in an abutting relationship with ornamentation adapter member 53 as shown in FIG. 2, the chances for accidental movement of ornamentation adapter member 53 with respect to decorative end member 52 is further minimized.

It should be readily apparent to one of ordinary skill in the art that the cross-sectional configurations for decorative shield member 62, post 51, decorative end member 52, and ornamentation adapter member 53 could be any desired geometric shape. The only restrictions on such configurations are that post 51 must be able to pass through opening 67 of decorative shield member 62 and decorative end member 52 must be able to pass through opening 70 and enter cavity 59 within ornamentation adapter member 53.

With reference now to FIGS. 3 and 4, another convertible pierced-earlobe earring 50', in accordance with the present invention is illustrated. Like reference numerals have been utilized in FIGS. 3 and 4 to designate components of earring 50' which have the same structure and characteristics as those previously described in connection with FIGS. 1 and 2. Earring 50' differs from earring 50 of FIGS. 1 and 2, in that an ornamentation member 80 is disposed between decorative shield member 62 and decorative end member 52, in a manner which is similar to the disposition of a portion of ornamentation adapter member 53, between decorative end member 52 and decorative shield member 62.

Ornamentation member 80, as seen in FIGS. 3 and 4, has a support member 81 removeably disposed upon the post 51 adjacent the decorative end member 52, and has downwardly, extending ornamentation 82 secured to the support member 81. Ornamentation 82 may be of any desired configuration, but is preferably of the type that is known as "dangle" type of earring construction. With use of decorative shield member 62, ornamentation member 80 does not contact the wearer's earlobe, whereby ornamentation member 80 may be manufactured of any inexpensive metallic or plastic material. The likelihood of the wearer suffering an allergic reaction has been minimized through use of the non-allergenic components of earring 50' as previously described in connection with earring 50.

Decorative shield member 62, post 51, decorative end member 52 and ornamentation member 80 might have any suitable desired cross-sectional configuration. The only constraints on the choice of the cross-sectional configuration of the components of earring 50' is that post 51 must be able to pass through opening 65 of decorative shield member 62, and post 51 must be able to pass through the support member 81 of ornamentation member 80.

It is to be understood that the invention is not limited to the exact details of construction, operation, exact materials or embodiment shown and described, as obvious modifications and equivalents will be apparent to one skilled in the art; for example, additional decorative shield members of different sizes could be utilized at the same time. Accordingly, the invention is therefore to be limited only by the scope of the appended claims

What is claimed is:

1. A convertible pierced-earlobe earring comprising:

(a) an elongate post having first and second ends and manufactured from a non-allergenic material and adapted to be passed though an earlobe;

(b) a substantially flat, decorative end member, manufactured from a non-allergenic material, and disposed at the first end of the post in a plane substantially perpendicular to the longitudinal axis of the post;

(c) an ornamentation adaptor member having ornamentation associated therewith and disposed adjacent the decorative end member, including means for releasably securing the ornamentation adaptor member to the decorative end member; the releasable securing means including a cavity disposed within the ornamentation adaptor member for receiving the decorative end member therein and retaining means having a transversely opening slot formed therein and extending along the rear side of said decorative end member when the decorative end member is received in the cavity with said post received in said slot for engaging an adjacent portion of the post; and (d) means for locking the post and ornamentation adaptor members, having the decorative end member received therein, with respect to the earlobe, the locking means being disposed adjacent the second end of the post and manufactured from a nonallergenic material, whereby the visual appearance of the earring may be altered through use of different ornamentation associated with the ornamentation adaptor member.

2. The earring of claim 1, wherein the non-allergenic material is gold.

3. The earring of claim 1, wherein a substantially planar decorative shield member, manufactured from a non-allergenic material, is releaseably disposed upon the post adjacent the decorative end member and in an abutting relationship with the ornamentation adaptor member.

4. The earring of claim 3, wherein the post includes means for bracing the decorative shield member to maintain the abutting relationship between the decorative shield member and the ornamentation adaptor member.

5. The earring of claim 1, wherein the ornamentation is formed integral with the ornamentation adaptor member.

6. A convertible pierced earring assembly comprising:

(a) a post assembly including an elongated post having front and rear ends and a disc-like end member secured on the front end of the post in substantially perpendicular relation thereto;

(b) an ornamentation adaptor assembly including an ornamentation element and releasable securing means on the rear side of the ornamentation element for releasably securing said ornamentation adaptor assembly on said end member, said releasable securing means including a transversely opening slot on the rear side of said adaptor assembly, said adaptor assembly being adapted for releasably receiving and capturing said end member in an attached position wherein said ornamentation element is disposed adjacent the front side of said end member, said post is slidably received in said slot and the portions of the securing means defining the slot extend along the rear side of said end member and engage an adjacent portion of said post assembly to releasably retain said ornamentation adaptor assembly on said end member; and (c) clutch means receivable on the rear end portion of said post for releasably securing said pierced earring assembly on an earlobe of a wearer.

7. In the convertible pierced earring assembly of claim 6, said releasable securing means engaging said post adjacent the rear side of said end member when said end member is in said attached position to secure said ornament adaptor assembly on said end member.

8. A convertible pierced-earlobe earring comprising:

(a) an elongate post having first and second ends and manufactured from a non-allergenic material and adapted to be passed through an earlobe;

(b) a substantially planar, decorative end member, manufactured from a non-allergenic material, and disposed at the first end of the post in a plane substantially perpendicular to the longitudinal axis of the post;

(c) at least one projection formed on the post and extending outwardly adjacent the decorative end member;

(d) a substantially planar, ornamentation adaptor member having ornamentation associated therewith and disposed adjacent the decorative end member, including means for releasably securing the ornamentation adaptor member to the decorative end member; the releasable securing means including a cavity disposed within the ornamentation adpator member for receiving the decorative end member therein and means for engaging a portion of the post disposed adjacent the decorative end member;

(e) a substantially flat decorative shield member manufactured from a non-allergenic material and having an opening therein, said shield member being releasably received on said post adjacent said decorative end member in abutting relationship with the ornamentation adaptor member with said post received in said opening, said opening being configured to permit said shield member to pass over said projection while nevertheless permitting said projection to operate to brace said shield member to maintain the latter in abutting relation with said ornamentation adaptor member; and (f) means for locking the post and ornamentation adaptor member, having the decorative end member received therein, with respect to the earlobe, the locking means being disposed adjacent the second end of the post and manufactured from a non-allergenic material, whereby the visual appearance of the earring may be altered through use of different ornamentation associated with the ornamentation adaptor member, and allergic reactions to the earring are minimized by the pierced portion of the earlobe only contacting non-allergenic materials.

9. The earring of claim 8, wherein the at least one projection comprises two outwardly extending pins radially disposed upon the post approximately 180° apart, and the decorative shield member has a first opening disposed therein which corresponds to the outer cross-sectional configuration of the post and has two openings disposed adjacent the first opening and radially spaced from one another approximately 180°, which openings correspond to the outer cross-sectional configuration of the two outwardly extending pins.

10. A convertible pierced-earlobe earring comprising:

(a) an elongate post having first and second ends and manufactured from a non-allergenic material and adapted to be passed through an earlobe;

(b) a substantially planar, decorative end member, manufactured from a non-allergenic material, and disposed at the first end of the post in a plane substantially perpendicular to the longitudinal axis of the post;

(c) a substnatially planar, ornamentation adaptor member having ornamentation associated therewith and disposed adjacent the decorative end member, including means for releasably securing the ornamentation adaptor member to the decorative end member; the releasable securing means including a cavity disposed within the ornamentation adpator member for receiving the decorative end member therein, an opening which permits the entry of the decorative end member into the cavity, and means for engaging a portion of the post disposed adjacent the decorative end member, said engagement means comprising an elongate passageway having first and second ends, the first end is disposed adjacent the opening and in communication therewith, the passageway having a configuration which corresponds to the outer cross-sectional configuration of the post, configuration of the post, whereby the decorative end member may be first inserted through the opening and into the cavity and then the post is moved into the first end of the passageway until the post engages the second end of the passageway and the decorative end member and ornamentation adaptor member are in an abutting relationship; and (d) means for locking the post and ornamentation adaptor member, having the decorative end member received therein, with respect to the earlobe, the locking means being disposed adjacent the second end of the post and manufactured from a non-allergenic material, whereby the visual appearance of the earring may be altered through use of different ornamentation associated with the ornamentation adaptor member, and allergic reactions to the earring are minimized by the pierced portion of the earlobe only contacting non-allergenic materials.

11. The earring of claim 10, wherein the opening in the ornamentation adaptor member has a configuration which is smaller than the outer configuration of the decorative end member, whereby the ornamentation adaptor member must be tilted with respect to the decorative end member in order to be inserted into the cavity.

12. A convertible pierced-earlobe earring comprising:

(a) an elongate post having first and second ends and manufactured from a non-allergenic material and adapted to be passed through an earlobe;

(b) a substantially planar, decorative end member, manufactured from a non-allergenic material, and disposed at the first end of the post in a plane substantiallly perpendicular to the longitudinal axis of the post;

(c) an ornamentation member having a support member removable disposed upon the post adjacent the decorative end member, and downwardly extending ornamentation secured to the support member;

(d) at least one projection formed on the post and extending outwardly adjacent the decorative end member;

(e) a substantially planar decorative shield member, manufactured from a non-allergenic material and having an opening therein, said shield member being releasably disposed upon the post adjacent the decorative end member and in an abutting relationship with the ornamentation member with said post received in said opening, said opening being configured to permit said shield member to pass over said projection while nevertheless permitting said projection to operate to brace said shield member to maintain the latter in abutting relation with said ornamentation adaptor member; and (f) means for locking the post, ornamentation member, and decorative end member with respect to the earlobe, the locking means being disposed adjacent the second end of the post and manufactured from a non-allergenic material, whereby the visual appearance of the earring may be altered through use of different ornamentation members associated with the post, and allergic reations to the earring are minimized by the pierced portion of the earlobe only contacting non-allergenic materials.

13. The earring of claim 12, wherein the at least one projection comprises two outwardly extending pins radially disposed upon the post approximately 180° apart, and the decorative shield member has a first opening disposed therein which corresponds to the outer cross-sectional configuration of the post and has two openings disposed adjacent the first opening and radially spaced from one another approximately 180°, which openings correspond to the outer cross-sectional configuration of the two outwardly extending pins.

* * * * *